US011142223B2

(12) United States Patent
Song et al.

(10) Patent No.: US 11,142,223 B2
(45) Date of Patent: Oct. 12, 2021

(54) SIDE WALL COMPONENT OF RAILWAY VEHICLE, AND RAILWAY VEHICLE

(71) Applicant: CRRC QINGDAO SIFANG CO., LTD., Qingdao (CN)

(72) Inventors: Bo Song, Qingdao (CN); Honglei Tian, Qingdao (CN); Haiyang Yu, Qingdao (CN); Renyuan Lv, Qingdao (CN); Longxi Liu, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 449 days.

(21) Appl. No.: 16/197,863

(22) Filed: Nov. 21, 2018

(65) Prior Publication Data

US 2019/0168781 A1 Jun. 6, 2019

(30) Foreign Application Priority Data

Sep. 6, 2018 (CN) ..... 201811038298.X

(51) Int. Cl.
*B61D 17/00* (2006.01)
*B61D 1/00* (2006.01)

(52) U.S. Cl.
CPC ..... *B61D 17/00* (2013.01); *B61D 1/00* (2013.01)

(58) Field of Classification Search
CPC ..... B61D 27/009; B61D 17/08
See application file for complete search history.

(56) References Cited

U.S. PATENT DOCUMENTS 2,664,808 A * 1/1954 Peterson ..... B61D 27/009 454/105
2,834,305 A * 5/1958 Dean ..... B61D 17/043 105/401
2,839,080 A * 6/1958 Copeland ..... F23C 7/008 137/625.4
2,894,443 A * 7/1959 Rasmussen ..... B60H 1/242 454/127
2,902,917 A * 9/1959 Peterson ..... F24F 13/078 454/108
3,659,515 A * 5/1972 Galaniuk ..... B60H 1/3407 454/152

(Continued)

FOREIGN PATENT DOCUMENTS

CN 20889816 Y 4/2007
CN 101544236 A 9/2009

(Continued)

*Primary Examiner* — Jason C Smith
(74) *Attorney, Agent, or Firm* — Cantor Colburn LLP

(57) ABSTRACT

Some embodiments of the present disclosure provide a side wall component of a railway vehicle, and a railway vehicle. The side wall component of a railway vehicle includes: a side wall, including a side wall body; and a plurality of side wall upright columns, connected with the side wall body respectively, the plurality of side wall upright columns being provided along a length direction of the side wall body at an interval, wherein an auxiliary air duct of a railway vehicle is formed between at least two of the plurality of side wall upright columns and the side wall body in the length direction of the side wall body. According to some embodiments of the present disclosure, an auxiliary air duct of a railway vehicle is directly formed on a side wall, so that the railway vehicle is compact in structure.

19 Claims, 14 Drawing Sheets

(56) References Cited

U.S. PATENT DOCUMENTS

| | | | | |
|---|---|---|---|---|
| 3,866,545 | A * | 2/1975 | Heap | B61D 9/06 105/406.1 |
| 4,848,517 | A * | 7/1989 | Broyles, III | B61D 5/08 182/83 |
| 5,111,739 | A * | 5/1992 | Hall | F24F 7/06 454/296 |
| 5,244,184 | A * | 9/1993 | Larseneur | B60H 1/00692 251/294 |
| 5,399,121 | A * | 3/1995 | Gray | B60H 1/245 454/137 |
| 6,327,981 | B1 * | 12/2001 | Nørregaard | B61D 17/043 105/396 |
| 8,764,526 | B2 * | 7/2014 | Hofler | B60H 1/262 454/83 |
| 8,808,075 | B2 * | 8/2014 | Gebke | B32B 3/10 454/297 |
| 9,457,638 | B2 * | 10/2016 | Hoefler | B61D 27/0072 |
| 9,599,362 | B2 * | 3/2017 | Leiterman | A01K 1/0047 |
| 2015/0166081 | A1 * | 6/2015 | Brendel | B61D 17/12 454/107 |
| 2018/0001915 | A1 * | 1/2018 | Richmond | B61F 5/26 |
| 2019/0084591 | A1 * | 3/2019 | Wang | B61F 1/14 |
| 2021/0053592 | A1 * | 2/2021 | Gupta | B61D 3/20 |

FOREIGN PATENT DOCUMENTS

| | | | |
|---|---|---|---|
| CN | 204701785 | U | 11/2015 |
| CN | 106080629 | A | 11/2016 |
| CN | 106627616 | A | 5/2017 |
| CN | 206141556 | U | 5/2017 |
| CN | 107415965 | A | 12/2017 |
| CN | 107512279 | A | 12/2017 |
| CN | 10701932 | A | 4/2018 |
| JP | 2200563 | A | 8/1990 |

* cited by examiner

SIDE WALL COMPONENT OF RAILWAY VEHICLE, AND RAILWAY VEHICLE

CROSS REFERENCE TO RELATED APPLICATION

This application is related to and claims the benefit of Chinese Patent Application Number 201811038298.X, filed on Sep. 6, 2018, the contents of which are incorporated herein by reference in their entirety.

TECHNICAL FIELD

The present disclosure relates to a technical field of railway vehicles, and in particular to a side wall component of a railway vehicle, and a railway vehicle.

BACKGROUND

In the conventional art, a side wall of a railway vehicle is additionally provided with an air duct structure. The air duct structure is usually a rectangular box formed by welding or riveting a plurality of aluminum alloy sheets, and then the rectangular box is riveted to a side wall of the railway vehicle. Although this independent air duct structure can ensure the ventilation effect inside the railway vehicle, the above air duct structure increases the weight of a vehicle body of the railway vehicle, occupies the internal space or external space of the railway vehicle, and affects the overall structure of the entire railway vehicle.

SUMMARY

Some embodiments of the present disclosure provide a side wall component of a railway vehicle and a railway vehicle, solve the problem in the conventional art of weight increase or volume increase of a railway vehicle caused by the arrangement of an additional air duct system on a side wall.

According to an embodiment of the present disclosure, a side wall component of a railway vehicle is provided. The side wall component includes: a side wall, including a side wall body; and a plurality of side wall upright columns, connected with the side wall body respectively, the plurality of side wall upright columns being provided along a length direction of the side wall body at an interval, wherein an auxiliary air duct of a railway vehicle is formed between at least two of the plurality of side wall upright columns and the side wall body in the length direction of the side wall body.

According to another embodiment of the present disclosure, a railway vehicle is provided. The railway vehicle includes a side wall component and a chassis component connected with the side wall component, the side wall component being the above side wall component.

By applying the embodiment of the present disclosure, a side wall body of a side wall and a side wall upright column are used to form an auxiliary air duct of a railway vehicle. Compared with the conventional art in which an air duct structure needs to be additionally provided and the additional air duct structure is welded or riveted to the exterior or interior of the side wall, the auxiliary air duct of the embodiment is formed on the side wall and does not protrude from the side wall, and the external or internal space of the vehicle cannot be additionally occupied, so that the integrity of the railway vehicle is ensured, thereby avoiding from increasing the wind resistance in the running process of the railway vehicle due to the additional air duct structure or occupying the internal space of the vehicle. Both the side wall body and the side wall upright column are members of the side wall, and the arrangement cannot increase the weight of the side wall. Therefore, in an embodiment of the present disclosure, the auxiliary air duct is directly formed on the side wall, thereby avoiding the problem of weight increase or volume increase or internal space reduction of the railway vehicle, so that the overall structure of the railway vehicle is compact.

BRIEF DESCRIPTION OF THE DRAWINGS

The accompanying drawings, which constitute a part of this application, are used to provide a further understanding of some embodiments of the present disclosure, and the exemplary embodiments of the present disclosure and the description thereof are used to explain the present disclosure, but do not constitute improper limitations to the present disclosure. In the drawings.

The drawings include the following reference signs:

70: side wall; 701: side wall body; 702: air duct opening; 703: under-window cross beam; 704: side wall corner column; 7041: first vertical plate; 7042: second vertical plate; 705: connecting structure; 706: reinforcing member;

73: vehicle window;

74: reinforcing structure; 741: first reinforcing plate; 742: second reinforcing plate; 743: flanging;

75: handrail mounting seat; 750: handrail bar; 751: first mounting plate; 752: second mounting plate; 753: arc-shaped plate; 754: connecting plate; 755: reinforcing plate; 756: third mounting plate; 757: fourth mounting plate; 758: mounting groove;

76: door frame; 761: first door frame; 762: second door frame; 763: reinforcing corner plate;

78: inner cover plate;

79: reinforcing cross beam; 791: first reinforcing cross beam; 791*a*: flange structure; 792: second reinforcing cross beam;

710: side wall upright plurality of; 7101: first folded edge; 7102: second folded edge; 7103: vertical edge; 7104: avoidance groove;

81: end wall corner column.

DETAILED DESCRIPTION OF THE EMBODIMENTS

It is to be noted that in the case of no conflict, the features in the embodiments and the embodiments in the present application may be combined with each other. The present disclosure is described below with reference to the drawings and in conjunction with the embodiments in detail.

Figure 1:
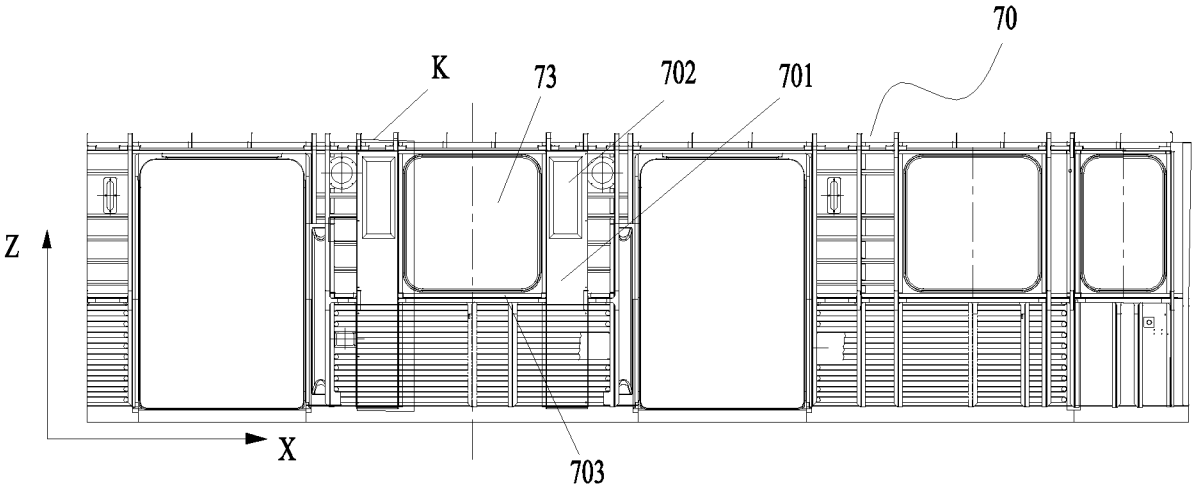
FIG. 1 illustrates a structural schematic diagram of a side wall component of a railway vehicle according to an embodiment of the present disclosure.

In some embodiments of the present disclosure, as shown in FIG. 1, a length direction of a side wall body 701 is an X direction, and a width direction of the side wall body 701 is a Z direction.

Figure 2:
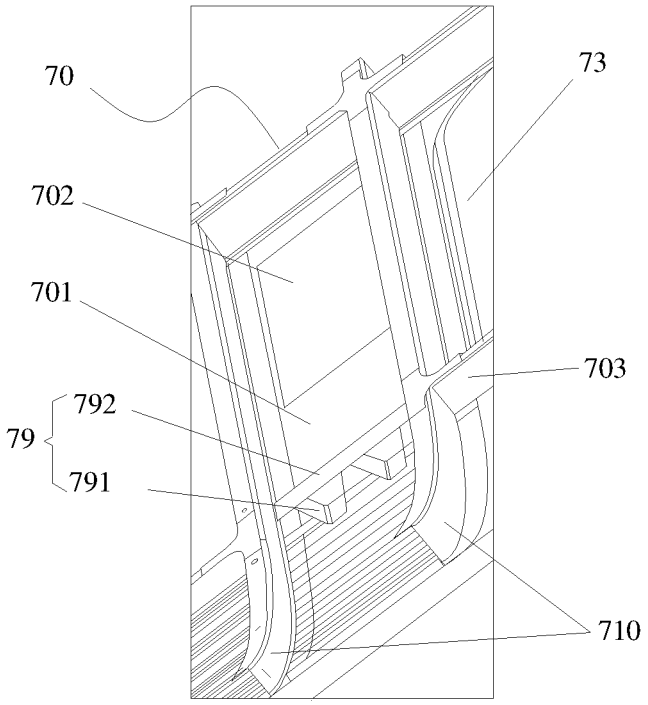
FIG. 2 illustrates a stereo-structure schematic diagram of the side wall component in FIG. 1 after a part K rotates for an angle (where a reinforcing cross beam is illustrated)

As shown in FIG. 1 and FIG. 2, an embodiment of the present disclosure provides a side wall component of a railway vehicle. The side wall component of the present embodiment includes a side wall 70 and a plurality of side wall upright columns 710. The side wall 70 includes a side wall body 701. The plurality of side wall upright columns 710 are connected with the side wall body 701 respectively, and the plurality of side wall upright columns 710 are provided at an interval along a length direction of the side wall body 701, wherein an auxiliary air duct of a railway vehicle is formed between at least two of the plurality of side wall upright columns 710 and the side wall body 701 in the length direction of the side wall body 701.

In an exemplary embodiment of the present disclosure, the side wall body 701 of the side wall 70 and the side wall upright columns 710 are used to form the auxiliary air duct of the railway vehicle. Compared with the conventional art in which an air duct structure needs to be additionally provided and the additional air duct structure is welded or riveted to an exterior of the side wall 70 or an interior of the side wall 70, the auxiliary air duct of the embodiment is formed on the side wall 70 and does not protrude from the side wall 70, and an external or internal space of the vehicle cannot be additionally occupied, so that the integrity of the railway vehicle is ensured, thereby avoiding from increasing the wind resistance in a running process of the railway vehicle due to the additional air duct structure or occupying the internal space of the vehicle. Both the side wall body 701 and the side wall upright columns 710 are members of the side wall 70, and the arrangement cannot increase the weight of the side wall 70. Therefore, the auxiliary air duct is formed on the side wall 70, thereby avoiding the problem of weight increase or volume increase of internal space reduction of the railway vehicle, so that the overall structure of the railway vehicle is compact.

In an exemplary embodiment, the auxiliary air duct is formed on the side wall 70, that is to say, the auxiliary air duct having a hollow structure is formed on the side wall 70, and the auxiliary air duct passes through the height direction of the side wall body 701, so that on the premise of meeting the internal ventilation of the railway vehicle, the weight of the vehicle body is reduced, and the light weight of the railway vehicle is realized.

In an exemplary embodiment, the auxiliary air duct and a chassis component of the railway vehicle are provided with a main air duct, which is communicated with the auxiliary air duct.

The main air duct is communicated with the auxiliary air duct, so that air in the entire railway vehicle circulates, thereby ensuring the circulation of air inside the railway vehicle, and improving the user experience.

Figure 5:
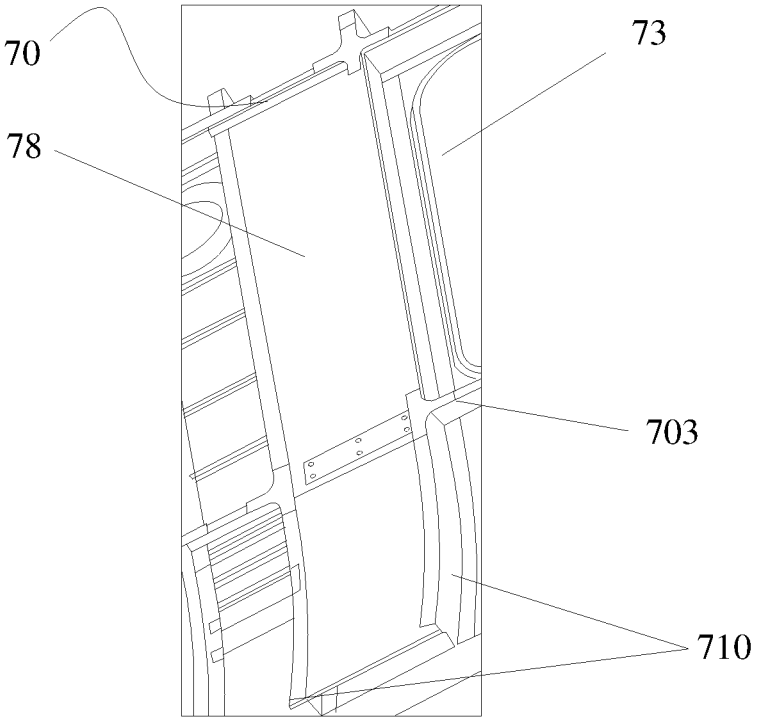
FIG. 5 illustrates a stereo-structure schematic diagram of the side wall component in FIG. 1 after a part K rotates for an angle (where an inner cover plate is illustrated)

As shown in FIG. 2 and FIG. 5, in an exemplary embodiment of the present disclosure, the side wall component further includes a vehicle window 73 provided on the side wall body 701, the at least two of the plurality of side wall upright columns 710 being located on a same side of the vehicle window 73.

In an exemplary embodiment, the auxiliary air duct is provided on the two side wall upright columns 710 located on the same side of the vehicle window 73. In the embodiment, an under-window cross beam is not provided between the two side wall upright columns 710 located on the same side of the vehicle window 73. Thus, the two side wall upright columns 710 and the side wall body 701 can be fully utilized to form an air duct, the entire auxiliary air duct can be kept to be smooth, and the ventilation effect of the auxiliary air duct is ensured.

Figure 3:
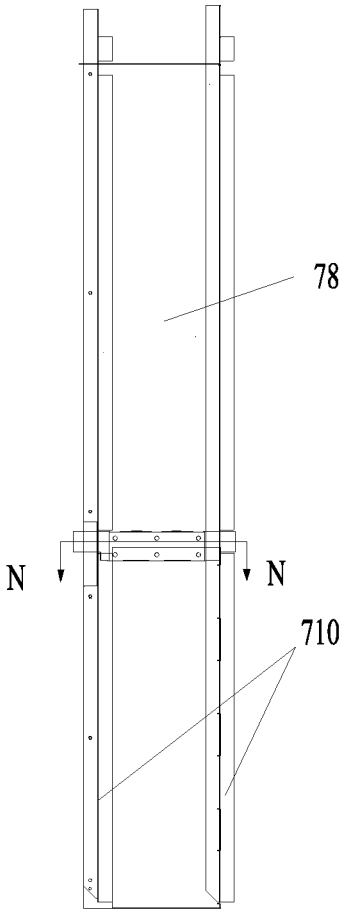
FIG. 3 illustrates a plane structure schematic diagram of a part K of the side wall component in FIG. 1 (where an inner cover plate is illustrated)

As shown in FIG. 3 and FIG. 5, in an embodiment of the present disclosure, the side wall component further includes an inner cover plate 78, wherein the inner cover plate 78 is provided on the at least two of the plurality of side wall upright columns 710 located on the same side of the vehicle window 73, and the inner cover plate 78, the at least two of the plurality of side wall upright columns 710 and the side wall body 701 jointly enclose the auxiliary air duct.

In an exemplary embodiment, the inner cover plate 78 covers the two side wall upright columns 710, so that the inner cover plate 78, the at least two of the plurality of side wall upright columns 710 and the side wall body 701 form an auxiliary air duct running through the side wall 70 along the height direction of the side wall body 701. The entire auxiliary air duct is simple in structure and convenient for connection, and does not occupy the internal space of the vehicle.

Of course, in an alternative embodiment not illustrated in the drawings of the present disclosure, only the two side wall upright columns 710 and the side wall body 701 may also enclose an auxiliary air duct, and a person skilled in the art may improve the structure of the side wall upright columns 710 as required to enclose the needed auxiliary air duct, so that the auxiliary air duct is formed on the side wall 70, as long as the structure in the inventive concept of the present application is improved within the scope of protection of the present application.

Figure 4:
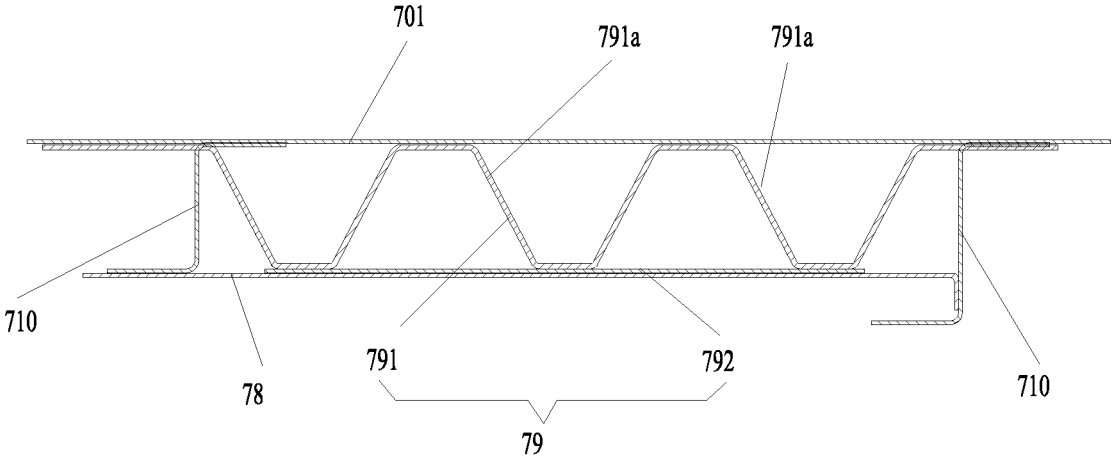
FIG. 4 illustrates an N-N sectional view of the side wall component in FIG. 3.

As shown in FIG. 2 and FIG. 4, in an exemplary embodiment of the present disclosure, the side wall component further includes a reinforcing cross beam 79 located in the auxiliary air duct, two opposite ends of the reinforcing cross beam 79 being correspondingly connected with the two side wall upright columns 710.

In an exemplary embodiment of the present disclosure, in order to ensure the structural strength of the auxiliary air duct part on the side wall 70, the reinforcing cross beam 79 is provided in the auxiliary air duct so as to match the overall strength of the entire side wall 70, thereby avoiding local damage to the entire side wall 70 caused by insufficient local strength.

In an exemplary embodiment, two opposite ends of the reinforcing cross beam 79 are correspondingly connected with the two side wall upright columns 710 along the length direction of the side wall body 701, so as to ensure the connecting strength of the reinforcing cross beam 79 in the auxiliary air duct, thereby avoiding the separation of the reinforcing cross beam 79.

As shown in FIG. 2 and FIG. 4, in an exemplary embodiment of the present disclosure, the auxiliary air duct 79 includes a first reinforcing cross beam 791 connected with the side wall body 701, and the first reinforcing cross beam 791 is provided with a transitional air duct communicated with the auxiliary air duct.

In an exemplary of the present disclosure, it is necessary to consider the air circulation of the entire auxiliary air duct to provide the auxiliary air duct 79. Therefore, the auxiliary air duct 79 in an embodiment of the present disclosure includes a first reinforcing cross beam 791 having a transitional air duct. The arrangement not only ensures the structural strength of the auxiliary air duct on the side wall 70, but also ensures the circulation of air in the auxiliary air duct.

As shown in FIG. 2 and FIG. 4, in an exemplary embodiment of the present disclosure, the auxiliary air duct 79 further includes a second reinforcing cross beam 792, the second reinforcing cross beam 792 is connected with the first reinforcing cross beam 791 and located between the first reinforcing cross beam 791 and the inner cover plate 78, wherein partial part of the transitional air duct is enclosed between the second reinforcing cross beam 792 and the first reinforcing cross beam 791, and the rest part of the transitional air duct is enclosed between the side wall body 701 and the first reinforcing cross beam 791.

In an exemplary embodiment, a part of the second reinforcing cross beam 792 is connected with a part of the first reinforcing cross beam 791, and a part of the first reinforcing cross beam 791 is connected with the side wall body 701. The provision of the transitional air duct ensures the penetration of the auxiliary air duct in the height direction of the side wall 70, and ensures the ventilation effect of the auxiliary air duct.

As shown in FIG. 2 and FIG. 4, in an exemplary embodiment of the present disclosure, the first reinforcing cross beam 791 includes a plurality of flange structures 791*a*, the plurality of flange structures 791*a* are provided at intervals, an inner wall surface of each flange structure 791*a* and an inner side of the second reinforcing cross beam 792 forming the transitional air duct.

In an exemplary embodiment, the first reinforcing cross beam 791 has a flange structure 791*a* of which the cross section is trapezoidal. The structure of the first reinforcing cross beam 791 in FIG. 4 is taken as an example. The inner wall surface of each flange structure 791*a* and the inner side of the second reinforcing cross beam 792 form the partial transitional air duct, and spacing between two adjacent flange structures 791*a* and the inner side of the side wall body 701 form another partial transitional air duct.

The arrangement ensures communication of the transitional air duct and the auxiliary air duct, so that the ventilation of the auxiliary air duct is smooth. Moreover, the strength of the first reinforcing cross beam 791 having the flange structure is good, and the structural strength of the side wall 70 forming the auxiliary air duct is ensured.

In an exemplary embodiment, the first reinforcing cross beam 791 is made of a metal plate by using a bending process. As shown in FIG. 4, the trapezoidal flange structure 791*a* has an upper bottom and a lower bottom, the upper bottom of the flange structure 791*a* is connected with the side wall body 701, and the lower bottom of the flange structure 791*a* is connected with the second reinforcing cross beam 792. By providing the second reinforcing cross beam 792, the connecting area between the reinforcing cross beam 79 and the inner cover plate 78 is increased, and the connecting strength between the reinforcing cross beam 79 and the inner cover plate 78 is improved.

Of course, in an alternative embodiment not illustrated in the drawings of the present disclosure, the shape of the cross section of the flange structure 791*a* of the first reinforcing cross beam 791 is not limited to trapezoid, and may be triangle, rectangle, arc or the like.

In an exemplary embodiment of the present disclosure, the first reinforcing cross beam 791 is welded to the side wall body 701, and the first reinforcing cross beam 791 is welded to the second reinforcing cross beam 792.

The welding connection strength is good, thereby ensuring the own structural strength of the reinforcing cross beam 79 and the connecting strength between the reinforcing cross beam 79 and the side wall body 701. A sealant is coated on the welding joint between the first reinforcing cross beam 791 and the side wall body 701, and a sealant is also coated on the welding joint between the first reinforcing cross beam 791 and the second reinforcing cross beam 792, so as to fill a gap at the welding joint, thereby ensuring the own structural strength of the reinforcing cross beam 79 and the connecting strength between the reinforcing cross beam 79 and the side wall body 701, and further ensuring that the strength of the side wall body 701 provided with the auxiliary air duct matches the overall strength of the entire side wall 70.

Figure 6:
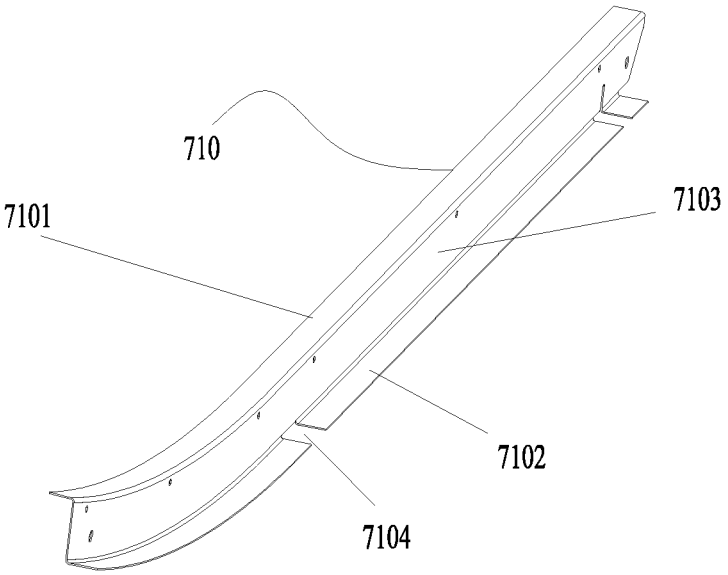
FIG. 6 illustrates a stereo-structure schematic diagram of a side wall upright column of the side wall component in FIG. 2.

As shown in FIG. 4 and FIG. 6, in an exemplary embodiment of the present disclosure, the side wall upright column 710 includes a first folded edge 7101, a second folded edge 7102 opposite to the first folded edge 7101, and a vertical edge 7103 connecting the first folded edge 7101 and the second folded edge 7102, the first folded edge 7101 is connected with the inner cover plate 78, and the second folded edge 7102 is connected with the side wall body 701.

In an exemplary embodiment, the first folded edge 7101 and the second folded edge 7102 are provided on two sides of the vertical edge 7103, and the first folded edge 7101 and the second folded edge 7102 are parallel to each other. The first folded edge 7101 is welded to the inner cover plate 78, and the second folded edge 7102 is welded to the side wall body 701.

By means of the arrangement, the side wall body 701, the side wall upright column 710 and the inner cover plate 78 are connected to form the entire auxiliary air duct, and the connecting strength is good.

In an exemplary embodiment, as shown in FIG. 4 and FIG. 6, the second folded edge 7102 is provided with an avoidance groove 7104 for allowing the first reinforcing cross beam 791 to pass through.

In the embodiment of the present application, a portion of the first reinforcing cross beam 791 is welded to the side wall body 701, and the second folded edge 7102 is provided with an avoidance groove 7104 for allowing the first reinforcing cross beam 791 to pass through, so as to connect the first reinforcing cross beam 791 and the side wall body 701.

Optionally, two opposite ends of the first reinforcing cross beam 791 are sandwiched between the side wall body 701 and the side wall upright columns 710, so that the mounting strength between the first reinforcing cross beam 791 and the side wall body 701 is ensured, thereby ensuring the structural strength of the auxiliary air duct.

As shown in FIG. 4 and FIG. 5, in an exemplary embodiment of the present disclosure, one end of the inner cover plate 78 is connected with the first folded edge 7101 of at least one side wall upright column 710 in the at least two side wall upright columns 710, the other end of the inner cover plate 78 is provided with a bending portion, and the bending portion is connected with the vertical edge 7103 of at least the other side wall upright column 710 in the at least two side wall upright columns 710.

In an exemplary embodiment, the inner cover plate 78 covers the two side wall upright columns 710, the first end of the inner cover plate 78 is welded to the first folded edge 7101 of one of the two side wall upright columns, the second end of the inner cover plate 78 is provided with a bending portion, the bending portion bends toward the first folded edge 7101, and the bending portion is welded to the vertical edge 7103 of the other one of the two side wall upright columns 710. The arrangement ensures the connecting strength between the inner cover plate 78 and the side wall upright column 710, and further ensures the integrity of the entire auxiliary air duct.

In an exemplary embodiment, the inner cover plate 78 is also welded to the second reinforcing cross beam 792. By providing the second reinforcing cross beam 792, the overall contact area between the inner cover plate 78 and the reinforcing cross beam 79 is increased, thus ensuring the mounting strength of the inner cover plate 78.

Of course, in an alternative embodiment not illustrated in the drawings of the present disclosure, the bending portion may also bend toward the second folded edge 7102, and the bending portion may be welded to the vertical edge 7103; or, the inner cover plate 78 may not be provided with a bending portion, so that the vertical edges 7103 of the two side wall upright columns 710 have the same width, and the second end of the inner cover plate 78 is directly welded to the first folded edge 7101 of the other side wall upright column 710. The above connection mode may realize the connection between the inner cover plate 78 and the side wall upright column 710.

As shown in FIG. 1 and FIG. 2, in an exemplary embodiment of the present disclosure, the side wall body 701 is provided with an air duct opening 702 communicated with the auxiliary air duct, and the air duct opening 702 is located above the reinforcing cross beam 79 along a height direction of the side wall body 701.

The arrangement enables air to flow into the auxiliary air duct from the air duct opening, thereby ensuring the air source of the auxiliary air duct. In an exemplary embodiment, in the railway vehicle of the present application, the side wall body 701 above the reinforcing cross beam 79 is a common metal plate structure, and the side wall body 701 below the reinforcing cross beam 79 is a corrugated plate structure. Therefore, the air duct opening 702 is provided above the reinforcing cross beam 79 conveniently, so as to avoid the structural strength of the side wall body 701 from being affected by provision of the air duct opening on the corrugated plate structure.

As shown in FIG. 1, FIG. 2 and FIG. 5, in an exemplary embodiment of the present disclosure, the side wall component further includes an under-window cross beam 703, the under-window cross beam 703 is located at a lower part of the vehicle window 73.

In the conventional art, the under-window cross beam extends up along the length direction of the side wall body, and extends to two adjacent door frames from the lower part of the vehicle window to two ends, so as to improve the strength of the side wall body in the length direction. Since the under-window cross beam is a closed structure, the arrangement mode of the under-window cross beam cannot form an air duct on the side wall body. In an embodiment of the present application, the under-window cross beam 703 is only provided at the lower part of the vehicle window 73, thereby ensuring the penetration of the auxiliary air duct in the height direction of the side wall 701, and ensuring the ventilation effect of the auxiliary air duct.

Figure 7:
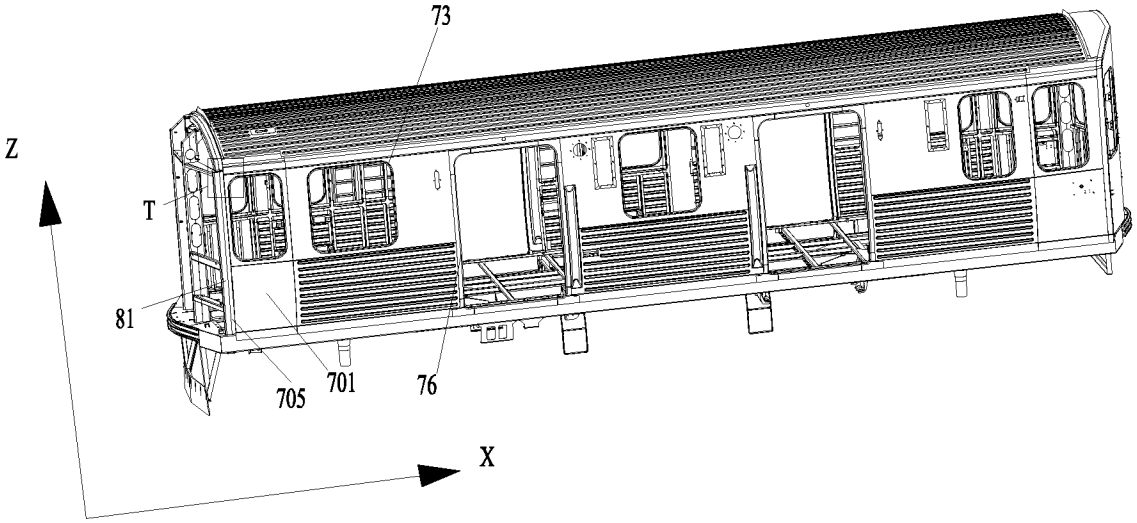
FIG. 7 illustrates a structural schematic diagram of a railway vehicle according to an embodiment of the present disclosure.

In the present disclosure and the embodiments of the present disclosure, as shown in FIG. 7, the length direction of the railway vehicle is an X direction, that is, the transversal direction of the side wall body, and the width direction of the railway vehicle is a Z direction, that is, the longitudinal direction of the side wall body.

Figure 8:
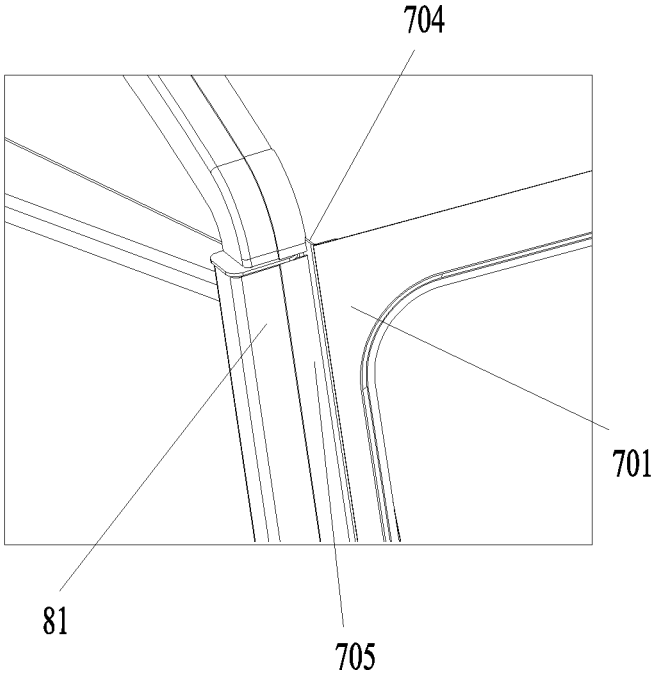
FIG. 8 illustrates a stereo-structure schematic diagram of a part T of the railway vehicle in FIG. 7.
Figure 9:
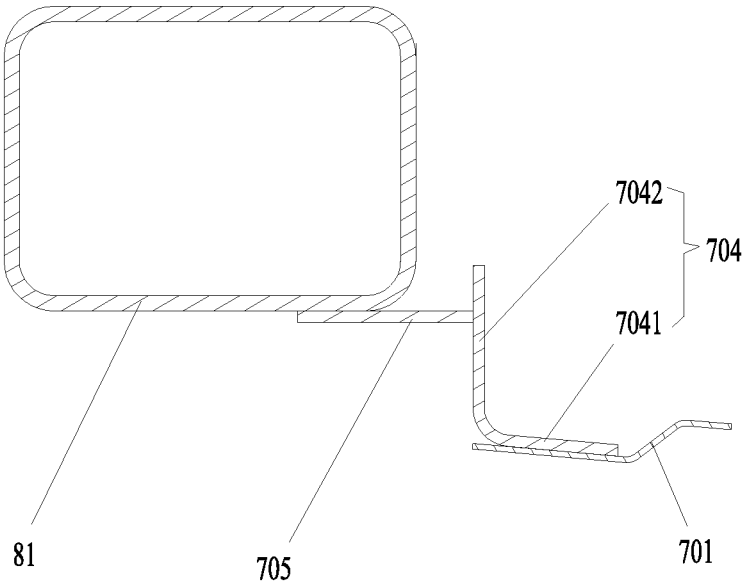
FIG. 9 illustrates a top view of a part T of the railway vehicle in FIG. 7.

As shown in FIG. 7 to FIG. 9, some embodiments of the present disclosure provide a side wall component of a railway vehicle. The side wall component of the present embodiment includes: a side wall body 701, a side wall corner column 704 and a connecting structure 705. The side wall corner column 704 is provided inside the side wall body 701, a first end of the connecting structure 705 is connected with an end wall corner column 81 of the railway vehicle, and a second end of the connecting structure 705 is connected with the side wall corner column 704.

In an embodiment of the present disclosure, since the connecting structure 705 is provided, errors generated by assembly are compensated by the connecting structure 705 when the end wall corner column 81 is connected with the side wall component, thus avoiding the side wall corner column 704 or the end wall corner column 81 from deforming during the connection, ensuring the connecting strength between the side wall corner column 704 and the end wall corner column 81, and further ensuring the connecting strength between the side wall component and the end wall component. Further, the connecting structure 705 may seal a gap between the side wall corner column 704 and the end wall corner column 81 caused by assembly errors or processing errors, thereby ensuring the sealing property of the entire vehicle body structure.

In the conventional art, due to the gap between the side wall component and the end wall component, the side wall corner column 704 or the end wall corner column 81 may deform by directly connecting the side wall corner column 704 and the end wall corner column 81, so that the side wall component or the end wall component is easily inclined, thereby affecting the strength of the entire vehicle body structure.

In order to solve the above problem, as shown in FIG. 9, in an exemplary embodiment of the present disclosure, the first end of the connecting structure 705 is lapped with an outer wall surface of the end wall corner column 81, and the second end of the connecting structure 705 abuts against the side wall corner column 704.

In an exemplary embodiment, after the side wall component and the end wall component are assembled completely, two ends of the connecting structure 705 are correspondingly connected with the end wall corner column 81 and the side wall corner column 704, so as to seal an assembly gap between the end wall corner column 81 and the side wall corner column 704 by using the connecting structure 705.

In an optional implementation manner, the first end of the connecting structure 705 and the outer wall surface of the end wall corner column 81 are lapped, and fixedly connected in a welding manner, so that the connecting strength is high, and the connection is stable. The second end of the connecting structure 705 abuts against the side wall corner column 704, and they are fixedly connected in a welding manner. The above arrangement further ensures the sealing property of the entire vehicle body structure, the connecting strength is good, and the connecting structure is compact.

As shown in FIG. 9, in an exemplary embodiment of the present disclosure, the side wall corner column 704 includes a first vertical plate 7041 and a second vertical plate 7042. The first vertical plate 7041 is fixedly connected with an inner wall surface of the side wall body 701, an included angle is formed between the second vertical plate 7042 and the first vertical plate 7041, and the second vertical plate 7042 is fixedly connected with the second end of the connecting structure 705.

In an exemplary embodiment of the present application, the section of the side wall corner column 704 is L-shaped along the height direction of the railway vehicle. The L-shaped side wall corner column 704 is simple in structure and good in strength. The second vertical plate 7042 is welded to the second end of the connecting structure 705, thereby ensuring the sealing property and connecting strength of the vehicle body structure.

As shown in FIG. 8 and FIG. 9, in an exemplary embodiment of the present disclosure, the connecting structure 705 is a flat connecting plate.

The connecting plate in the embodiment is a metal plate. The connecting plate is simple in structure and convenient for connection. Moreover, a surface-to-surface contact is formed between the connecting plate and the end wall corner column 81, thus improving the connecting strength.

Figure 10:
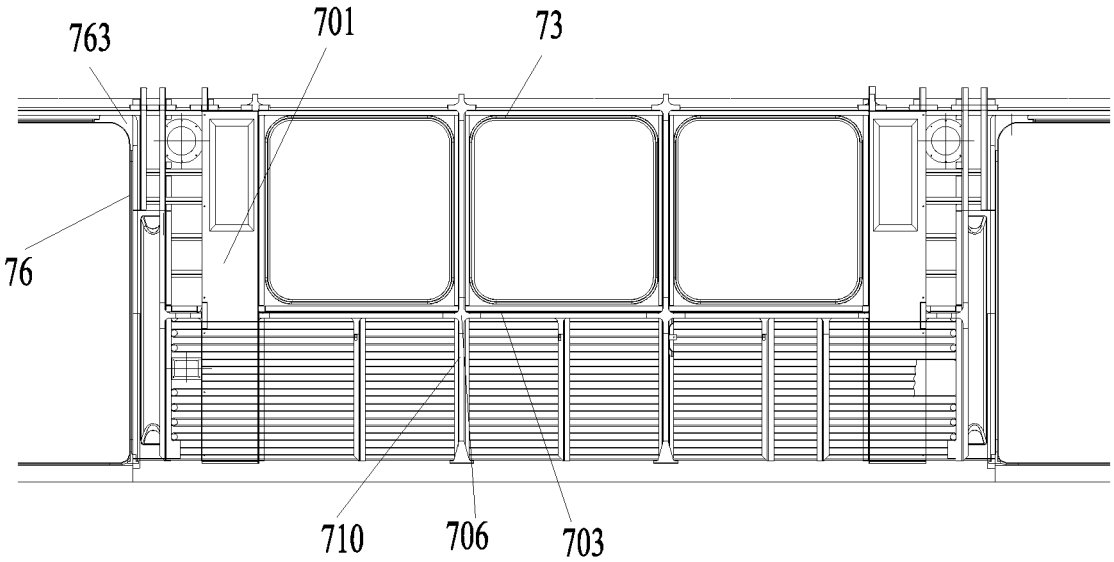
FIG. 10 illustrates a local structure schematic diagram of a side wall component of the railway vehicle in FIG. 7.

As shown in FIG. 10, in an exemplary embodiment of the present disclosure, the side wall component further includes a vehicle window 73, an under-window cross beam 703, and a plurality of side wall upright columns 710. The under-window cross beam 703 is located below the vehicle window 73, the plurality of side wall upright columns 710 are connected with the side wall body 701 respectively, and the plurality of side wall upright columns 710 are provided at an interval along the length direction of the side wall body 701, wherein at least one side wall upright column 710 is connected with the under-window cross beam 703.

In an exemplary embodiment of the present disclosure, each of the plurality of side wall upright columns 710 includes a first folded edge, a second folded edge opposite to the first folded edge, and a vertical edge connecting the first folded edge and the second folded edge, the first folded edge and the second folded edge are located on two opposite sides of the vertical edge and extend toward the opposite directions, the second folded edge is connected with the side wall body 701, and the under-window cross beam 703 extends in the length direction of the side wall body 701, so that the strength of the side wall body in the length direction can be improved. The each of the plurality of side wall upright columns 710 and the under-window cross beam 703 are lapped to form a crisscross connecting portion. In the above arrangement, the under-window cross beam 703 extends along the transversal direction of the side wall body 701 (the X direction as shown in FIG. 10), and the each of the plurality of side wall upright columns 710 extends along the longitudinal direction of the side wall body 701 (the Z direction as shown in FIG. 10), so that the side wall body 701 is supported horizontally and longitudinally, thereby improving the structure strength of the entire side wall component.

As shown in FIG. 10, in an exemplary embodiment of the present disclosure, a reinforcing member 706 is provided at the joint between at least one side wall upright column 710 and the under-window cross beam 703.

In an exemplary embodiment, the reinforcing member 706 is a cross reinforcing member. The cross reinforcing member is provided on the crisscross connecting portion of the side wall upright column 710 and the under-window cross beam 703. The arrangement increases the connecting strength between the side wall upright column 710 and the under-window cross beam 703, thus improving the overall structure strength of the side wall component.

As shown in FIG. 10, in an exemplary embodiment of the present disclosure, the reinforcing member 706 is fixedly connected with the side wall upright column 710, and the reinforcing member 706 is fixedly connected with the under-window cross beam 703.

The reinforcing member 706 in the embodiment of the present disclosure is welded to the side wall upright column 710, and the reinforcing member 706 is welded to the under-window cross beam 703. The arrangement ensures the connecting strength between the reinforcing member 706 and the side wall upright column 710, so as to achieve the firm connection between the under-window cross beam 703 and the side wall upright column 710, thus improving the overall structure strength of the side wall component.

As shown in FIG. 10, in an exemplary embodiment of the present disclosure, the side wall component further includes a door frame 76, the door frame 76 is fixedly connected with the side wall body 701, and the door frame 76 is provided with a reinforcing corner plate 763.

In an exemplary embodiment, the door frame 76 is of an integrated structure and is made of stainless steel, and the strength of the door frame 76 is further improved by providing the reinforcing corner plate 763 on the door frame 76.

In an exemplary embodiment, the reinforcing corner plate 763 is welded to the door frame 76, thus ensuring the connecting strength between the reinforcing corner plate 763 and the door frame 76.

As shown in FIG. 10, in an exemplary embodiment of the present disclosure, the door frame 76 has a corner portion, the reinforcing corner plate 763 corresponding to the corner portion.

Figure 23:
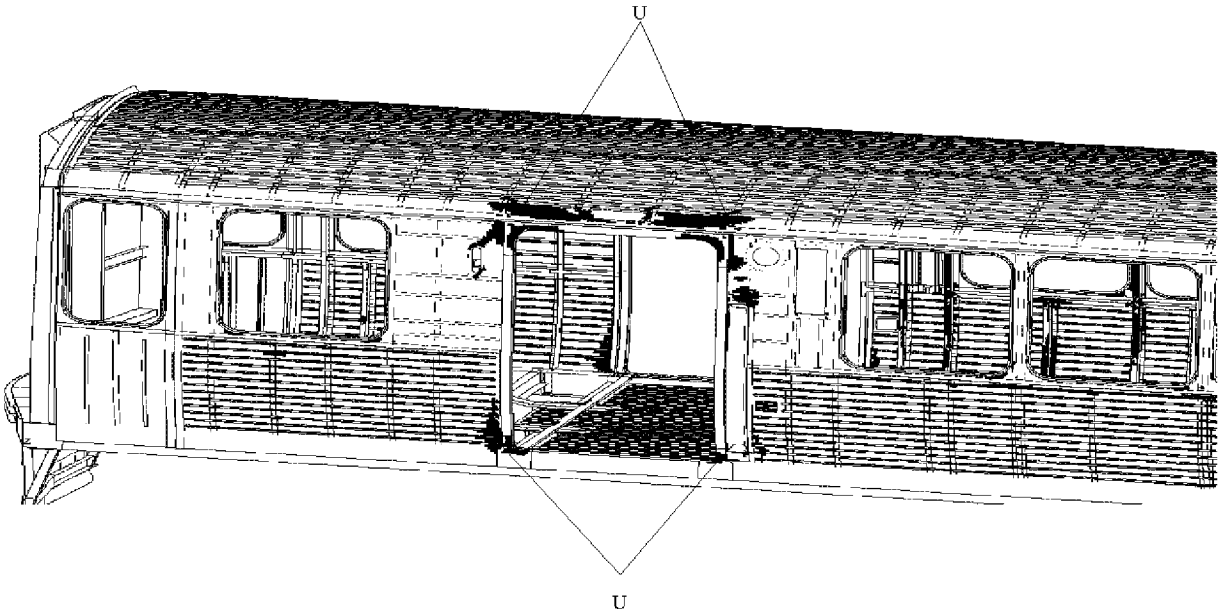
FIG. 23 illustrates a stress nephogram of a side wall component according to an embodiment of the present disclosure.

As shown in FIG. 23, a stress nephogram of a side wall component of a railway vehicle according to an embodiment of the present disclosure is illustrated. A part U in FIG. 23 is a stress concentration position, located on the corner portion of the door frame 76. For the stress distribution characteristics, the corner portion of the door frame 76 is provided with the reinforcing corner plate 763 for reinforcement, so as to improve the strength of the door frame 76.

In an exemplary embodiment, the side wall component includes four reinforcing corner plates 763, and the four reinforcing corner plates 763 are correspondingly provided on four corner portions of the door frame 76, so as to reinforce the door frame 76 from different parts of the door frame 76, thereby ensuring the overall strength of the door frame 76.

As shown in FIG. 10, in an exemplary embodiment of the present disclosure, the window frame of the vehicle window 73 is formed in a punching manner.

In an exemplary embodiment, the window frame of the vehicle window 73 can be punched by the process steps of drawing, trimming, punching and flanging, the strength of the punched window frame is high, the integrity is good, and there is no need to provide a reinforcing structure for reinforcement.

As shown in FIG. 7, some embodiments of the present disclosure also provide a railway vehicle. The railway vehicle includes a side wall component and a chassis component connected with the side wall component, the side wall component being the above side wall component.

The side wall component of the present application includes the connecting structure 705, and the connecting structure 705 may compensate assembly errors between the side wall component and the end wall component, thus avoiding the side wall corner column 704 or the end wall corner column 81 from deforming during the connection, ensuring the connecting strength between the side wall corner column 704 and the end wall corner column 81, and further ensuring the connecting strength between the side wall component and the end wall component. Therefore, the railway vehicle having the above side wall component also has the above advantages.

In an exemplary embodiment, the chassis component is provided with a corner column mounting hole, and the end wall corner column 81 is provided in the corner column mounting hole in a penetration manner.

In an exemplary embodiment, the chassis component includes a lower boundary beam, the corner column mounting hole is provided on the lower boundary beam, and the end wall corner column 81 is provided in the corner column mounting hole in a penetration manner, so that the connection between the end wall corner column 81 and the chassis component is realized.

As shown in FIG. 8 and FIG. 9, after the end wall component and the side wall component are assembled completely, the end wall corner column 81 and the side wall corner column 704 are connected by the connecting structure 705. In the presence of processing errors and assembly errors, after the end wall component and the side wall component are assembled completely, a certain gap exists between the end wall corner column 81 and the side wall corner column 704. During the connection, after the first end of the connecting structure 705 and the outer wall surface of the end wall corner column 81 are lapped, the connecting structure 705 is moved along the length direction of the railway vehicle, so that the second end of the connecting structure 705 abuts against the side wall corner column 704, thus ensuring that the connecting structure 705 fully covers the gap between the end wall corner column 81 and the side wall corner column 704. The connecting structure is fixedly connected with the end wall corner column 81 and the side wall corner column 704 in a welding manner respectively, so that the connection between the side wall corner column 704 and the end wall corner column 81 is realized.

Figure 11:
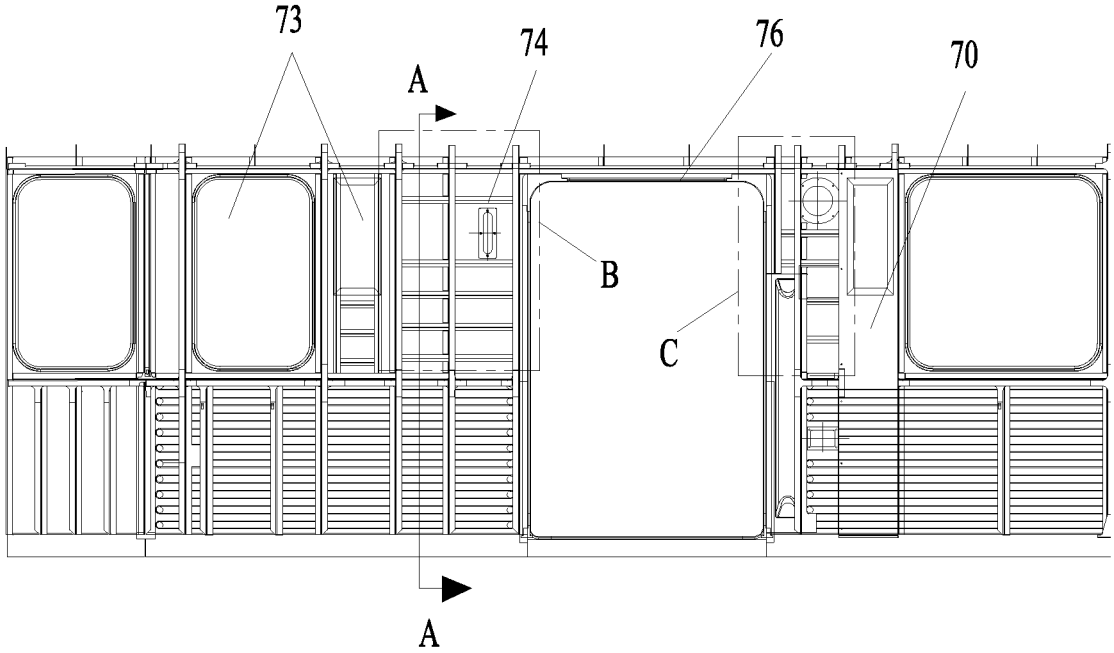
FIG. 11 illustrates a structural schematic diagram of a side wall component of a railway vehicle according to an embodiment of the present disclosure.
Figure 12:
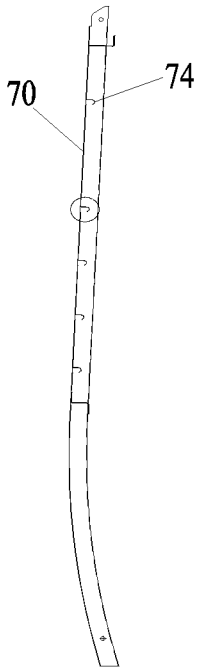
FIG. 12 illustrates an A-A sectional view of FIG. 11.

As shown in FIG. 11 and FIG. 12, some embodiments of the present disclosure provide a reinforcing structure of a side wall of a railway vehicle. The reinforcing structure 74 includes a reinforcing body and a flanging 743 connected with the reinforcing body, the reinforcing body is fixedly connected with the side wall 70, and the flanging 743 and the side wall 70 are provided at an interval.

In the embodiment, the reinforcing structure 74 is provided on the side wall 70 of the railway vehicle to reinforce the strength of the side wall 70. The reinforcing structure includes a reinforcing body and a flanging 743 connected with the reinforcing body. Compared with the conventional art in which an L-shaped reinforcing structure is provided on the side wall 70, the reinforcing structure of the present embodiment has the flanging 743, thereby avoiding from scratching an operator by the sharp end of the reinforcing structure, and facilitating mounting and maintenance.

In an exemplary embodiment of the present disclosure, as shown in FIG. 12, the side wall 70 includes a side wall body provided on the outside and an interior member provided on the inside. The reinforcing structure 74 is provided on the side wall body. When a cold-proof material is filled between the side wall body and the interior member, the flanging 743 of the reinforcing structure 74 cannot prevent filling of the cold-proof material. Compared with an n-shaped reinforcing structure or an m-shaped reinforcing structure in the conventional art, the reinforcing structure 74 of the present embodiment facilitates attaching and bonding of the cold-proof material, thereby facilitating the development of a subsequent process.

Figure 13:
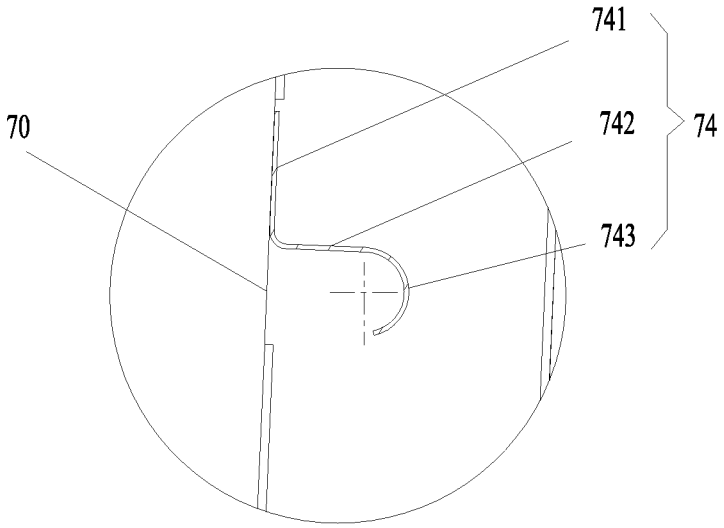
FIG. 13 illustrates a partial enlarged schematic diagram of FIG. 12.
Figure 14:
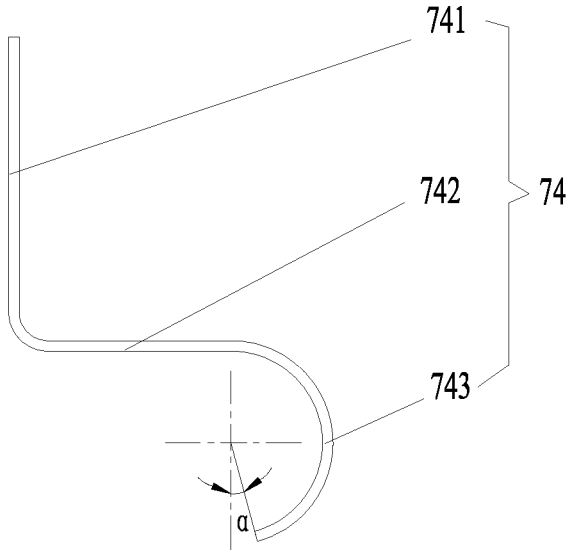
FIG. 14 illustrates a structural schematic diagram of a reinforcing structure in FIG. 13.

As shown in FIG. 13 and FIG. 14, the reinforcing body includes a first reinforcing plate 741 and a second reinforcing plate 742. The first reinforcing plate 741 is connected with the side wall 70. A first end of the second reinforcing plate 742 is connected with the first reinforcing plate 741, a second end of the second reinforcing plate 742 is connected with the flanging 743, and an included angle is formed between the second reinforcing plate 742 and the first reinforcing plate 741.

In an exemplary embodiment, the first reinforcing plate 741 and the second reinforcing plate 742 form an L-shaped reinforcing body, the first reinforcing plate 741 is connected with the side wall 70 so as to improve the strength of the side wall 70 in the height direction, and an included angle is formed between the second reinforcing plate 742 and the first reinforcing plate 741 so as to improve the strength of the side wall 70 in the width direction.

In an exemplary embodiment, the first reinforcing plate 741 is vertically connected with the second reinforcing plate 742.

Of course, in an alternative embodiment not illustrated in the drawings of the present disclosure, the included angle between the second reinforcing plate 742 and the first reinforcing plate 741 may be randomly set as long as performing of a subsequent process is not affected.

In the embodiment of the present disclosure, the first reinforcing plate 741 is welded to the side wall 70.

The first reinforcing plate 741 is connected with the side wall 70 in a spot welding manner, and a spot welding sealant is provided between the first reinforcing plate 741 and the side wall 70, thereby ensuring the connecting strength between the first reinforcing plate 741 and the side wall 70. A gap between the first reinforcing plate 741 and the side wall 70 is sealed, so that the first reinforcing plate 741 can be effectively prevented from being separated.

As shown in FIG. 13 and FIG. 14, in an exemplary embodiment of the present disclosure, the flanging 743 and the first reinforcing plate 741 are located on two sides of the second reinforcing plate 742 respectively.

In an exemplary embodiment of the present disclosure, the first reinforcing plate 741, the second reinforcing plate 742 and the flanging 743 are of an integrated molding structure, one end of the second reinforcing plate 742 is connected with the first reinforcing plate 741, the other end of the second reinforcing plate 742 is connected with the flanging 743, and the first reinforcing plate 741 and the flanging 743 are located on two sides of the second reinforcing plate 742 respectively. The above arrangement facilitates the mounting operation of an operator. Compared with the scenario where the first reinforcing plate 741 and the flanging 743 are provided on a same side of the second reinforcing plate 742, the arrangement mode of the present embodiment facilitates forming, and it is convenient for the operator to mount the reinforcing structure 74 on the side wall 70. The tail end of the flanging 743 faces the side wall 70, thereby avoiding from scratching the operator during mounting.

In an exemplary embodiment, the reinforcing structure 74 is integrally made from a steel plate that is 1 mm thick.

As shown in FIG. 13 and FIG. 14, in an exemplary embodiment of the present disclosure, the section of the flanging 743 is circular arc-shaped.

The section mentioned here is the section made along the width direction of the vehicle, that is, an A-A sectional direction in FIG. 11. The circular arc-shaped flanging 743 makes the tail end of the reinforcing structure 74 face the side wall 70. Compared with the L-shaped reinforcing structure in the conventional art, the tail end of the reinforcing structure 74 of the present application is bent, so that it is unlikely for the operator to touch the sharp end of the reinforcing structure 74, thereby avoiding scratching.

As shown in FIG. 14, in an exemplary embodiment of the present disclosure, an included angle $\alpha$ is provided between a connecting line of the tail end of a circular arc and the center of the circular arc and a plane where the first reinforcing plate 741 is located, where the included angle $\alpha$ is greater than or equal to 15° and smaller than or equal to 25°.

In an exemplary embodiment, the included angle $\alpha$ is 15°. The setting of the included angle $\alpha$ ensures that the flanging 743 has a certain radian, which not only can meet the own structure requirement of the flanging 743, but also can achieve a hooking effect on a cold-proof material when the cold-proof material is filled in the side wall 70. The influence on filling of the cold-proof material due to the fact that the flanging 743 is too small is avoided, or scratching of the operator due to the fact that the flanging 743 is too large is avoided.

As shown in FIG. 11, in an exemplary embodiment of the present disclosure, the side wall 70 includes an upper side wall and a lower side wall connected with the upper side wall, and the reinforcing structure 74 is provided on the upper side wall.

In an exemplary embodiment, the upper side wall is made of a common sheet steel, the lower side wall is made of a corrugated plate, and the strength of the corrugated plate is much higher than the strength of the common sheet steel. Therefore, in order to improve the strength of the upper side wall, the reinforcing structure 74 is provided on the upper side wall, so as to meet the strength requirement of the side wall 70.

In an exemplary embodiment of the present disclosure, the side wall structure includes a plurality of reinforcing structures 74, the upper side wall is provided with a vehicle window 73, and the plurality of reinforcing structures 74 are provided on at least one side of the vehicle window 73 at an interval to form a reinforcing area.

As shown in FIG. 11, the upper side wall is provided with a vehicle window 73, and the plurality of reinforcing structures 74 are provided at an interval on at least one side of the vehicle window 73 to form a reinforcing area, so as to improve the strength of the side wall 70 surrounding the vehicle window 73, as shown in an area B in FIG. 11.

Of course, in an alternative embodiment not illustrated in the drawings, the plurality of reinforcing structures 74 may be provided on two sides of the vehicle window 73 at an interval according to practical situations.

In an exemplary embodiment, the side wall structure includes a plurality of reinforcing structures 74, the side wall 70 is provided with a door frame 76, and the plurality of reinforcing structures 74 are provided on at least one side of the door frame 76 at an interval to form a reinforcing area.

As shown in FIG. 11, in an exemplary embodiment, the side wall 70 is provided with a vehicle door, and the plurality of reinforcing structures 74 are provided on upper side wall parts on two sides of the door frame 76 of the vehicle door to form a reinforcing area, so as to improve the strength of the side wall 70 surrounding the door frame 76, as shown in areas B and C in FIG. 11, thereby meeting the strength requirement of the side wall 70.

In an exemplary embodiment, the upper side wall 70 is also provided with a vent hole (such as a circular vent hole in an area C in FIG. 11), and the above reinforcing structures 74 are also provided around the vent hole, so that the strength of the hole position of the side wall 70 can be ensured.

In the embodiment of the present disclosure, a plurality of reinforcing structures 74 are provided around the hole position on the upper side wall, and the reinforcing structures 74 may be provided horizontally or longitudinally as required to form a reinforcing area, so as to improve the strength of the upper side wall, thereby avoiding from affecting the appearance of the side wall caused by the bending deformation of the upper side wall.

In the conventional art, in order to reduce the weight of the vehicle body, the stainless steel side wall 70 should be as thin as possible on the premise of meeting the strength requirement. However, the sheet is prone to buckling deformation without supporting, so as to cause the bad appearance of the side wall 70.

Some embodiments of the present disclosure provide the section of a reinforcing structure 74. During production, reinforcing structures 74 with different lengths can be made as required. By reasonably arranging the reinforcing structures 74 along the longitudinal and horizontal directions of the side wall 70, a buckling reinforcement area on the side wall 70 (in particular, the upper side wall) is formed, so that the problem in the conventional art of buckling of the stainless steel side wall 70 due to insufficient rigidity is solved.

The length direction and height direction of the railway vehicle in some embodiments of the present disclosure are as shown in FIG. 10, an X direction is the length direction of the vehicle, and a Z direction is the height direction.

Figure 15:
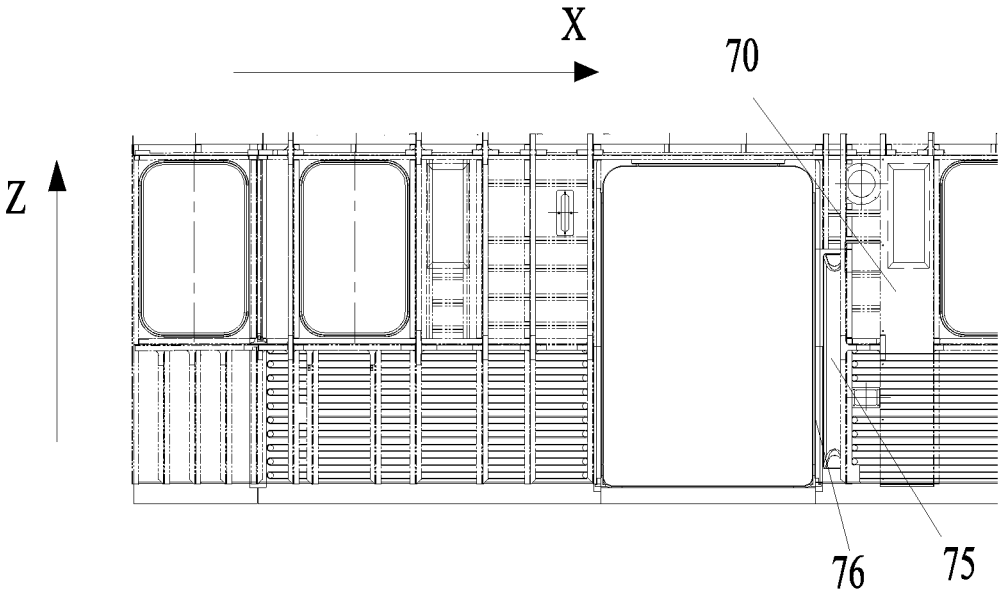
FIG. 15 illustrates a structural schematic diagram of a handrail mounting seat of a side wall component of a railway vehicle assembled with the vehicle according to an embodiment of the present disclosure.

As shown in FIG. 15, some embodiments of the present disclosure provide a side wall component of a railway vehicle. The side wall component of the present embodiment includes a side wall 70 and a handrail mounting seat 75. The handrail mounting seat 75 is provided on the side wall 70, the handrail mounting seat 75 is provided with a handrail mounting groove 758, the handrail mounting groove 758 is used for mounting a handrail bar 750, and the handrail mounting groove 758 is depressed toward the internal direction of the vehicle.

In the embodiment, since the mounting groove 758 is depressed into the vehicle, the handrail bar 750 is not protruded from the external profile of the vehicle after being mounted in the mounting groove 758, thereby ensuring the good overall appearance of the railway vehicle, avoiding from rubbing against or colliding with the external environment during running, and also avoiding air resistance caused by the protrusion of the handrail bar 750 from the side wall 70. Therefore, the above arrangement ensures the appearance attractiveness of the vehicle, and makes the integrity of the vehicle good.

Figure 16:
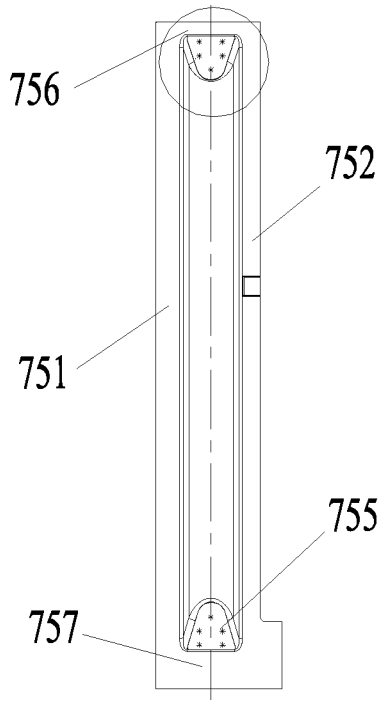
FIG. 16 illustrates a front view of the handrail mounting seat in FIG. 15.
Figure 17:
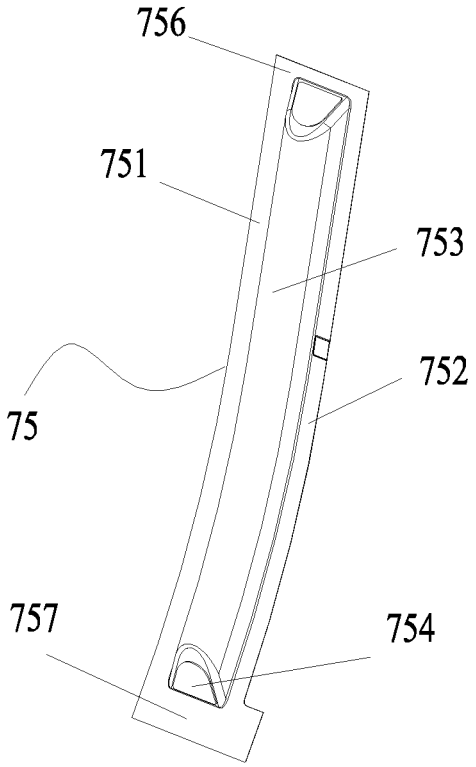
FIG. 17 illustrates a stereo-structure schematic diagram of the handrail mounting seat in FIG. 16.

As shown in FIG. 15 to FIG. 17, in an exemplary embodiment of the present disclosure, the handrail mounting seat 75 includes a first mounting plate 751 and a second mounting plate 752 connected with the first mounting plate 751, and a mounting groove for mounting a handrail bar is formed between the first mounting plate 751 and the second mounting plate 752, wherein the first mounting plate 751 is connected with an L-shaped door frame 76 of the vehicle, and the second mounting plate 752 is connected with the side wall 70 of the vehicle.

In the embodiment of the present disclosure, the handrail mounting seat 75 is used for mounting the handrail bar 750. The handrail mounting seat 75 is mounted on the vehicle by the first mounting plate 751 and the second mounting plate 752, so that the handrail mounting seat 75 can be fixedly mounted on the vehicle. Moreover, the first mounting plate 751 of the handrail mounting seat 75 is connected with the L-shaped door frame 76 of the vehicle along the length direction of the vehicle, and the second mounting plate 752 of the handrail mounting seat 75 is connected with the side wall 70 of the vehicle, so that the connecting strength between the handrail mounting seat 75 and the vehicle body is ensured, space between the door frame 76 and the side wall 70 is fully utilized, a passenger can conveniently hold the handrail bar 750, and the problem that the passenger cannot conveniently hold the handrail bar 750 due to the fact that two mounting plates of the handrail mounting seat 75 are connected with the side wall 70 and the handrail mounting seat 75 is away from the door frame 76 is avoided.

Therefore, by means of the above arrangement, the connecting strength between the handrail mounting seat 75 and the vehicle body is good, space is fully utilized in the length direction of the vehicle body, and it is ensured that the passenger can conveniently hold the handrail bar 750 after it is mounted on the handrail mounting seat 75.

Figure 22:
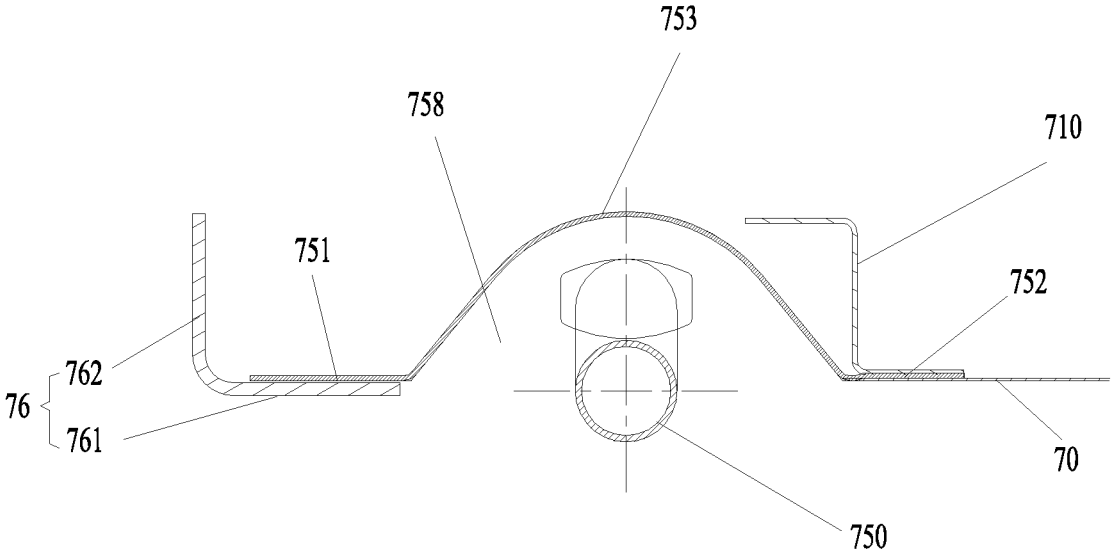
FIG. 22 illustrates a D-D direction sectional view of FIG. 21.

As shown in FIG. 22, in the embodiment of the present disclosure, the second mounting plate 752 is located between the side wall body and at least one of the plurality of side wall upright columns 710.

In an exemplary embodiment, the handrail mounting seat 75 is provided between the at least one of the plurality of side wall upright columns 710 and the door frame 76 along the length direction of the vehicle. The second mounting plate 752 is embedded between the side wall body and the side wall upright column 710, so that the handrail mounting seat 75 is not protruded from the outer surface of the side wall 70, thereby ensuring the attractiveness of the vehicle body.

In an exemplary embodiment of the present disclosure, the side wall upright column 710 is a Z-shaped side wall upright column, the side wall upright column 710 includes a first upright column, a second upright column and a third upright column connected in sequence, and the first upright column is connected with the second mounting plate 752.

The side wall upright column 710 in an exemplary embodiment is a Z-shaped side wall upright column, the structure is simple, and the connecting strength is high. The second mounting plate 752 is connected with the first upright column of the Z-shaped side wall upright column, so that the second mounting plate 752 is embedded between the first upright column and the side wall body, thereby ensuring that the handrail mounting seat 75 is not protruded from the outer surface of the side wall 70. Moreover, the second mounting plate 752 is in surface-to-surface connection with the first upright column, thereby ensuring the connecting strength of the handrail mounting seat 75.

In an exemplary embodiment of the present disclosure, the second mounting plate 752 is welded to the first upright column, and a sealant is provided between the second mounting plate 752 and the first upright column.

In an exemplary embodiment, the second mounting plate 752 is connected to the first upright column in a spot welding manner, thereby ensuring the connecting strength between the second mounting plate 752 and the first upright column to further ensure the mounting strength of the handrail mounting seat 75 connected to the side wall 70. Further, a spot welding sealant is provided at the welding joint to seal a gap between the second mounting plate 752 and the first upright column, thereby improving the connecting strength.

In an exemplary embodiment of the present disclosure, the first mounting plate 751 is welded to the L-shaped door frame 76, and a sealant is provided between the first mounting plate 751 and the L-shaped door frame 76.

In an exemplary embodiment, the first mounting plate 751 is connected with the L-shaped door frame 76 in a spot welding manner, thereby ensuring the connecting strength between the first mounting plate 751 and the L-shaped door frame to further ensure the mounting strength of the handrail mounting seat 75 connected with the L-shaped door frame. In an exemplary embodiment, a spot welding sealant is provided at the welding joint to seal a gap between the first mounting plate 751 and the L-shaped door frame, thereby improving the connecting strength.

As shown in FIG. 17 and FIG. 22, in an exemplary embodiment of the present disclosure, the handrail mounting seat 75 further includes an arc-shaped plate 753 provided between the first mounting plate 751 and the second mounting plate 752, a mounting groove is provided on the arc-shaped plate 753, and after the handrail bar 750 is mounted in the mounting groove, the handrail bar 750 is flush with the outer surface of the side wall 70.

In an exemplary embodiment, the handrail bar 750 is mounted in the mounting groove on the arc-shaped plate 753, and the arc-shaped plate 753 is depressed from the outside of the vehicle body to the inside of the vehicle body to make the mounting groove embedded into the side wall 70, so that after the handrail bar 750 is mounted in the mounting groove, the handrail bar 750 is not protruded from the outer surface of the side wall 70, thereby ensuring the attractiveness of the vehicle body.

In an exemplary embodiment, the handrail mounting seat 75 is mounted outside the vehicle body and provided on one side of the door frame 76, for being held by the passenger when getting on. The mounting groove of the handrail mounting seat 75 of the present embodiment is depressed inward, so that the handrail bar 750 is flush with the outer surface of the side wall 70, thereby avoiding from rubbing against or colliding with the external environment during running, and also avoiding air resistance caused by the protrusion of the handrail bar 750 from the side wall 70.

Of course, in an alternative embodiment not illustrated in the drawings of the present disclosure, the shape of the arc-shaped plate 753 is not limited to the circular arc shape, or may be other shapes, as long as it is ensured that the arc-shaped plate 753 is provided with a mounting groove for mounting the handrail bar 750 and the handrail bar 750 is not protruded from the outer surface of the side wall 70 after the handrail bar 750 is mounted in the mounting groove.

In an exemplary embodiment of the present disclosure, the first mounting plate 751, the arc-shaped plate 753 and the second mounting plate 752 are of an integrated molding structure.

The arrangement ensures the overall strength of the handrail mounting seat 75, so that after the handrail mounting seat 75 is fixedly connected with the vehicle body through the first mounting plate 751 and the second mounting plate 752, the arc-shaped plate 753 is mounted on the vehicle body accordingly, so that the integrity is good, and the mounting procedure is simplified.

In an exemplary embodiment of the present disclosure, the handrail mounting seat 75 is formed by a punching process.

The arrangement ensures the overall strength of the handrail mounting seat 75.

Figure 20:
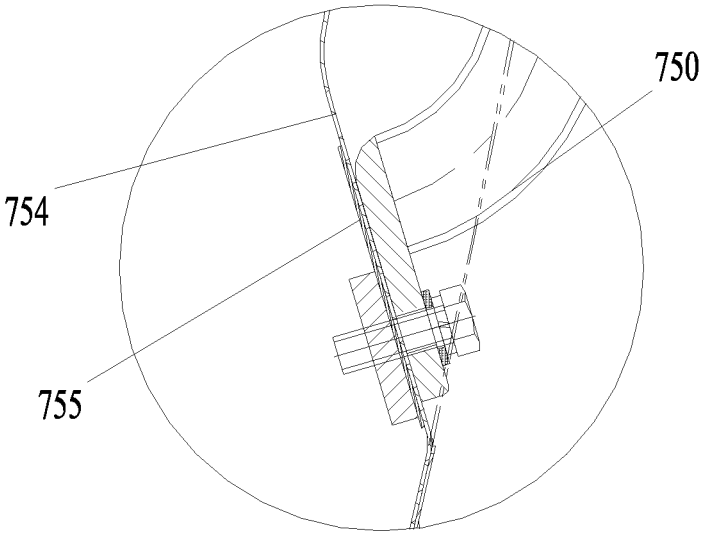
FIG. 20 illustrates a partial enlarged schematic diagram of FIG. 19.
Figure 21:
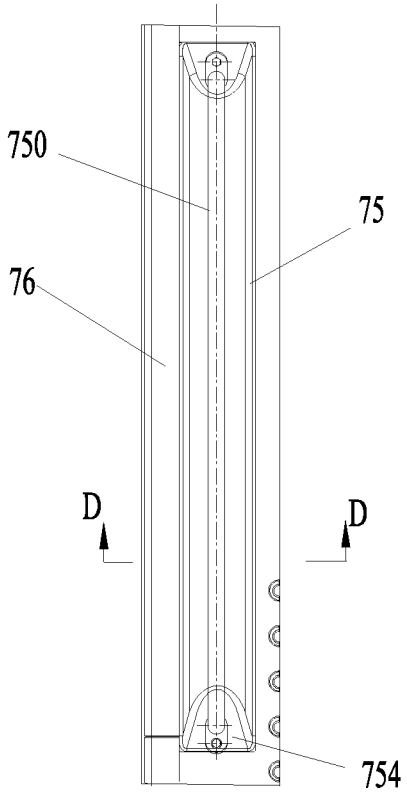
FIG. 21 illustrates a front view of FIG. 19.

As shown in FIG. 17, FIG. 20 and FIG. 21, in an exemplary embodiment of the present disclosure, the handrail mounting seat 75 further includes connecting plates 754, two opposite ends of the arc-shaped plate 753 are correspondingly provided with the connecting plates 754, and the handrail bar 750 is fixedly connected with the connecting plates 754 through fasteners.

In an embodiment of the present disclosure, the connecting plates 754 are provided at two ends of the arc-shaped plate 753, two ends of the handrail bar 750 are provided with mounting portions, and the mounting portions at two ends of the handrail bar 750 are mounted on the connecting plates 754 through fasteners, so as to achieve a function of mounting the handrail bar 750 on the handrail mounting seat 75.

Figure 18:
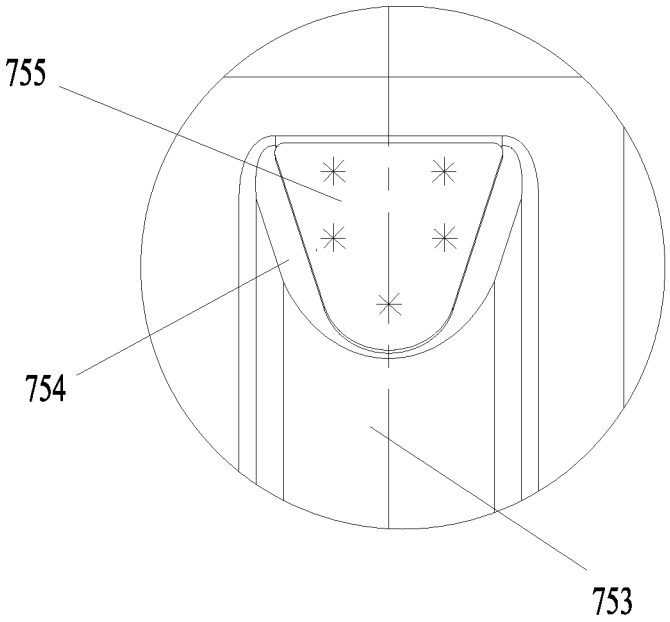
FIG. 18 illustrates a partial enlarged schematic diagram of FIG. 16.
Figure 19:
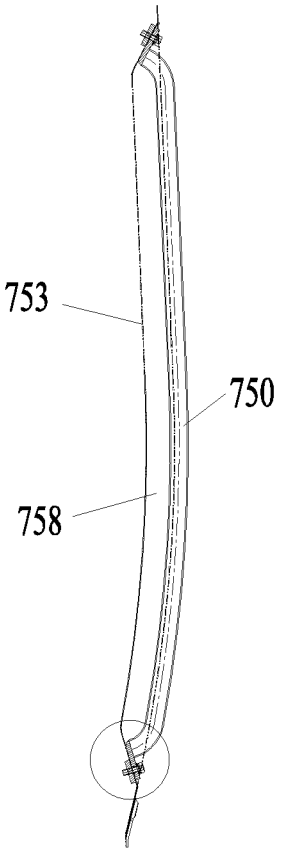
FIG. 19 illustrates a structural schematic diagram of a handrail bar assembled to the handrail mounting seat.

As shown in FIG. 18 and FIG. 20, in an exemplary embodiment of the present disclosure, a reinforcing plate 755 is provided on a side, away from the handrail bar 750, of the connecting plate 754.

In an exemplary embodiment, the reinforcing plate 755 and the handrail bar 750 are provided on two sides of the connecting plate 754. In an exemplary embodiment, the reinforcing plate 755 is connected with the connecting plate 754 in a spot welding manner, and a spot welding sealant is provided between the reinforcing plate 755 and the connecting plate 754.

The arrangement improves the strength of the connecting plate 754, and ensures the stability of connection between the handrail bar 750 and the connecting plate 754.

As shown in FIG. 16 and FIG. 17, in an exemplary embodiment of the present disclosure, the handrail mounting seat 75 further includes a third mounting plate 756 and a fourth mounting plate 757 provided oppositely along the height direction of the vehicle, the third mounting plate 756 and the fourth mounting plate 757 are used for connecting the first mounting plate 751 and the second mounting plate 752 respectively.

In an exemplary embodiment of the present disclosure, the third mounting plate 756 is connected with the first mounting plate 751 and the second mounting plate 752 respectively, the fourth mounting plate 757 is connected with the first mounting plate 751 and the second mounting plate 752 respectively, the first mounting plate 751 and the second mounting plate 752 are used for mounting the left and right sides of the handrail mounting seat 75 on the vehicle body, and the third mounting plate 756 and the fourth mounting plate 757 are used for mounting the upper and lower sides of the handrail mounting seat 75 on the vehicle body, so as to achieve a function of fixedly mounting the entire handrail mounting seat 75 on the vehicle body.

By means of the arrangement, the circumference of the handrail mounting seat 75 is fixedly connected with the vehicle body, thereby ensuring the overall mounting strength of the handrail mounting seat 75.

In an exemplary embodiment, the side wall 70 includes a side wall body, and both the third mounting plate 756 and the fourth mounting plate 757 are fixedly connected with the side wall body.

In an exemplary embodiment of the present disclosure, both the third mounting plate 756 and the fourth mounting plate 757 are inserted into the side wall body, and are welded to the side wall body. The arrangement further ensures embedding of the handrail mounting seat 75 into the vehicle body.

As shown in FIG. 22, in an exemplary embodiment of the present disclosure, the L-shaped door frame 76 includes a first door frame 761 and a second door frame 762 connected with the first door frame 761, the first mounting plate 751 is located inside the first door frame 761, and the first mounting plate 751 is connected with the first door frame 761.

In an exemplary embodiment of the present disclosure, the door frame 76 is L-shaped, the first door frame 761 of the door frame 76 is parallel to the side wall 70, the second door frame 762 is vertical to the side wall 70, the first mounting plate 751 is connected with the first door frame 761, and the first mounting plate 751 is located inside the first door frame 761. In an exemplary embodiment, the first door frame 761 is connected with the first mounting plate 751 in a spot welding manner, and a sealant is provided between the first door frame 761 and the first mounting plate 751.

The embodiment ensures that the handrail mounting seat 75 is embedded into the vehicle body, the connecting strength between the first door frame 761 and the first mounting plate 751 is high, and the service life of the handrail mounting seat 75 is prolonged.

From the above description, it can be seen that the above embodiment of the present disclosure achieves the following technical effects: a side wall body of a side wall and a side wall upright column are used to form an auxiliary air duct of a railway vehicle. Compared with the conventional art in which an air duct system needs to be additionally provided and the additional air duct system is welded or riveted to the exterior of the side wall, the auxiliary air duct of the present application is formed on the side wall and does not protrude from the side wall, and the external space of the vehicle cannot be additionally occupied, so that the integrity of the railway vehicle is ensured, thereby avoiding from increasing the wind resistance in the running process of the railway vehicle due to the additional air duct system. Both the side wall body and the side wall upright are members of the side wall, and the arrangement cannot increase the weight of the side wall. Therefore, by means of the arrangement, the auxiliary air duct is formed on the side wall, thereby avoiding the problem of weight increase or volume increase of the railway vehicle, so that the overall structure of the railway vehicle is compact.

The above is only the preferred embodiments of the present disclosure, not intended to limit the present disclosure. As will occur to those skilled in the art, the present disclosure is susceptible to various modifications and changes. Any modifications, equivalent replacements, improvements and the like made within the spirit and principle of the present disclosure shall fall within the scope of protection of the present disclosure.

What is claimed is:

1. A side wall component of a railway vehicle, comprising:

a side wall, comprising a side wall body;

a plurality of side wall upright columns, connected with the side wall body respectively, the plurality of side wall upright columns being provided along a length direction of the side wall body, wherein an auxiliary air duct of the railway vehicle is formed between at least two of the plurality of side wall upright columns and the side wall body in the length direction of the side wall body; and a reinforcing cross beam located in the auxiliary air duct, wherein the side wall component comprises two side wall upright columns, two opposite ends of the reinforcing cross beam are correspondingly connected with the two side wall upright columns respectively.

2. The side wall component as claimed in claim 1, wherein the auxiliary air duct is communicated with a main air duct on a chassis component of the railway vehicle.

3. The side wall component as claimed in claim 2, further comprising:

a side wall corner column, provided inside the side wall body; and a connecting structure, a first end of the connecting structure being connected with an end wall corner column of the railway vehicle, and a second end of the connecting structure being connected with the side wall corner column.

4. The side wall component as claimed in claim 2, further comprising:

a handrail mounting seat, provided on the side wall, the handrail mounting seat being provided with a handrail mounting groove, the handrail mounting groove being used for mounting a handrail bar, and the handrail mounting groove being depressed toward an internal direction of the vehicle.

5. The side wall component as claimed in claim 4, wherein the handrail mounting seat comprises a first mounting plate and a second mounting plate connected with the first mounting plate, the handrail mounting groove being located between the first mounting plate and the second mounting plate, wherein the first mounting plate is connected with an L-shaped door frame of the vehicle, and the second mounting plate is connected with the side wall.

6. The side wall component as claimed in claim 5, wherein the second mounting plate is located between the side wall body and at least one of the plurality of side wall upright columns.

7. The side wall component as claimed in claim 6, wherein the at least one of the plurality of side wall upright columns is a Z-shaped side wall upright column, the side wall upright column comprises a first upright column, a second upright column and a third upright column connected in sequence, and the first upright column is connected with the second mounting plate.

8. The side wall component as claimed in claim 5, wherein the handrail mounting seat further comprises an arc-shaped plate provided between the first mounting plate and the second mounting plate, and the mounting groove is formed on the arc-shaped plate.

9. The side wall component as claimed in claim 8, wherein the first mounting plate, the arc-shaped plate and the second mounting plate are an integrated molding structure.

10. The side wall component as claimed in claim 2, further comprising a vehicle window provided on the side wall body, and further comprising an under-window cross beam, the under-window cross beam being located at a lower part of the vehicle window.

11. The side wall component as claimed in claim 2, further comprising a reinforcing structure, wherein the reinforcing structure comprises a reinforcing body and a flanging connected with the reinforcing body, the reinforcing body is fixedly connected with the side wall body, and the flanging and the side wall body are provided at an interval.

12. The side wall component as claimed in claim 11, wherein the reinforcing body comprises:

a first reinforcing plate, connected with the side wall body; and a second reinforcing plate, a first end of the second reinforcing plate being connected with the first reinforcing plate, a second end of the second reinforcing plate being connected with the flanging, and an included angle being formed between the second reinforcing plate and the first reinforcing plate.

13. The side wall component as claimed in claim 12, wherein the flanging and the first reinforcing plate are located on two sides of the second reinforcing plate respectively.

14. The side wall component as claimed in claim 2, further comprising an inner cover plate, the inner cover plate, the at least two of the plurality of side wall upright columns and the side wall body jointly enclosing the auxiliary air duct.

15. The side wall component as claimed in claim 1, further comprising:

a vehicle window, provided on the side wall body; and an inner cover plate, the inner cover plate being provided on at least two side wall upright columns on a same side of the vehicle window.

16. The side wall component as claimed in claim 1, wherein the reinforcing cross beam comprises:

a first reinforcing cross beam, connected with the side wall body, the first reinforcing cross beam being provided with a transitional air duct communicated with the auxiliary air duct;

a second reinforcing cross beam, connected with the first reinforcing cross beam; and an inner cover plate, the second reinforcing cross beam being located between the first reinforcing cross beam and the inner cover plate, wherein a part of the transitional air duct is enclosed between the second reinforcing cross beam and the first reinforcing cross beam, and/or, a rest part of the transitional air duct is enclosed between the side wall body and the first reinforcing cross beam.

17. The side wall component as claimed in claim 16, wherein the first reinforcing cross beam is welded to the side wall body, and/or, the first reinforcing cross beam is welded to the second reinforcing cross beam.

18. The side wall component as claimed in claim 1, wherein the side wall body is provided with an air duct opening communicated with the auxiliary air duct, and the air duct opening is located above the reinforcing cross beam along a height direction of the side wall body.

19. A railway vehicle, comprising a side wall component and a chassis component connected with the side wall component, wherein the side wall component is the side wall component as claimed in claim 1.

* * * * *